US009935357B2

(12) United States Patent
Bologna et al.

(10) Patent No.: US 9,935,357 B2
(45) Date of Patent: Apr. 3, 2018

(54) ANTENNA SOLUTION FOR NARROW BEZEL SYSTEM

(71) Applicant: Dell Products L.P., Round Rock, TX (US)

(72) Inventors: Benny J. Bologna, Austin, TX (US); Mark Andrew Schwager, Cedar Park, TX (US); Julian Spencer, Cedar Park, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 15/226,023

(22) Filed: Aug. 2, 2016

(65) Prior Publication Data

US 2018/0040940 A1 Feb. 8, 2018

(51) Int. Cl.
*H01Q 1/24* (2006.01)
*H01Q 1/22* (2006.01)
*H01Q 1/50* (2006.01)

(52) U.S. Cl.
CPC ..... *H01Q 1/2266* (2013.01); *H01Q 1/50* (2013.01)

(58) Field of Classification Search
CPC ..... H01Q 1/24; H01Q 1/2266; H01Q 1/50
USPC ..... 343/702
See application file for complete search history.

(56) References Cited

U.S. PATENT DOCUMENTS 3,611,063 A * 10/1971 Neale ..... H01L 45/04 257/4
6,829,140 B2 * 12/2004 Shimano ..... G06F 1/162 248/919
8,289,688 B2 * 10/2012 Behar ..... G06F 1/162 361/679.27
8,312,991 B2 * 11/2012 Diebel ..... A45C 11/00 206/305
8,896,487 B2 * 11/2014 Chiang ..... G06F 1/1616 343/700 MS
2011/0260919 A1 * 10/2011 Montag ..... H01Q 3/24 342/374

OTHER PUBLICATIONS

U.S. Appl. No. 15/132,362, filed Apr. 19, 2016 entitled Information Handling System Low Profile Housingand Hinge Assembly, 27 pages.

* cited by examiner

*Primary Examiner* — Huedung Mancuso
(74) *Attorney, Agent, or Firm* — Baker Botts L.L.P.

(57) ABSTRACT

Systems and methods are disclosed for positioning an antenna in a portable information handling system. A portable information handling system includes a housing having a first housing portion and a second housing portion. The portable information handling system also includes a hinge assembly rotationally coupling the first and second housing portions. The portable information handling system also includes an antenna disposed within the first housing portion, the antenna operable to transmit radio waves. The portable information handling system further includes an antenna aperture formed within the first housing portion. The second housing portion comprises a radio frequency (RF) permeable region comprising RF permeable material, the RF permeable region located in proximity to the antenna aperture when the portable information handling system is in tablet mode, tablet mode representing the first housing portion rotated approximately 360 degrees from the second housing portion.

17 Claims, 9 Drawing Sheets

ANTENNA SOLUTION FOR NARROW BEZEL SYSTEM

TECHNICAL FIELD

This disclosure relates generally to information handling systems and, more particularly, to a system and method for integration of antennas in an information handling system with a narrow bezel design.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Examples of information handling systems include portable information handling systems, such as, smart phones, tablet computers, notebook computers, media players, digital cameras, 2-in-1 tablet-laptop combination computers, wireless organizers, and/or combinations thereof. A portable information handling system may generally be any device that a user may carry for handheld use and that includes a processor. These systems may communicate across wireless networks information, such as voice, images, text, video, and data. A portable information handling system may rely on one or more antennas to communicate such information wirelessly. The reception and transmission capabilities of individual antennas may change based on the placement and/or surroundings of the antenna. Thus, antennas of the portable information handling system may be affected by the physical configuration of the portable information handling system, which may change as a user uses, configures, and/or moves the system. Antenna position may also affect specific absorption rate (SAR) measurements of the systems. Thus, it may be desirable to control the placement of one or more antennas in a portable information handling system.

SUMMARY

In some embodiments, a portable information handling system is disclosed that includes a housing having a first housing portion and a second housing portion. The system also includes a hinge assembly rotationally coupling the first and second housing portions. In addition, the system includes an antenna disposed within the first housing portion, the antenna operable to transmit radio waves. The system further includes an antenna aperture formed within the first housing portion such that at least a portion of the radio waves transmitted from the antenna travel through the antenna aperture. In the system, the second housing portion comprises a radio frequency (RF) permeable region comprising RF permeable material, the RF permeable region located in proximity to the antenna aperture when the portable information handling system is in tablet mode, tablet mode representing the first housing portion rotated approximately 360 degrees from the second housing portion.

In another embodiment, a method is disclosed that includes rotationally coupling a first housing portion and a second housing portion of the portable information handling system with a hinge assembly. The method also includes placing the antenna within the first housing portion, the antenna operable to transmit radio waves. The method further includes forming an antenna aperture within the first housing portion such that at least a portion of the radio waves travel through the antenna aperture. In addition, the method includes placing a radio frequency (RF) permeable region comprising RF permeable material within the second housing portion, the RF permeable region located in proximity to the antenna aperture when the portable information handling system is in tablet mode, tablet mode representing the first housing portion rotated approximately 360 degrees from the second housing portion.

In other embodiments, a portable information handling system is disclosed that includes a housing having a first housing portion and a second housing portion. The system also includes a hinge assembly rotationally coupling the first and second housing portions. In addition, the system includes an antenna disposed within the first housing portion, the antenna operable to transmit radio waves. The first housing portion includes an electrically conductive portion and a low-electrically conductive portion, wherein the low-electrically conductive portion is located at an edge of the first housing portion to dissipate a surface current created by the radio waves from the antenna.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

Figure 1:
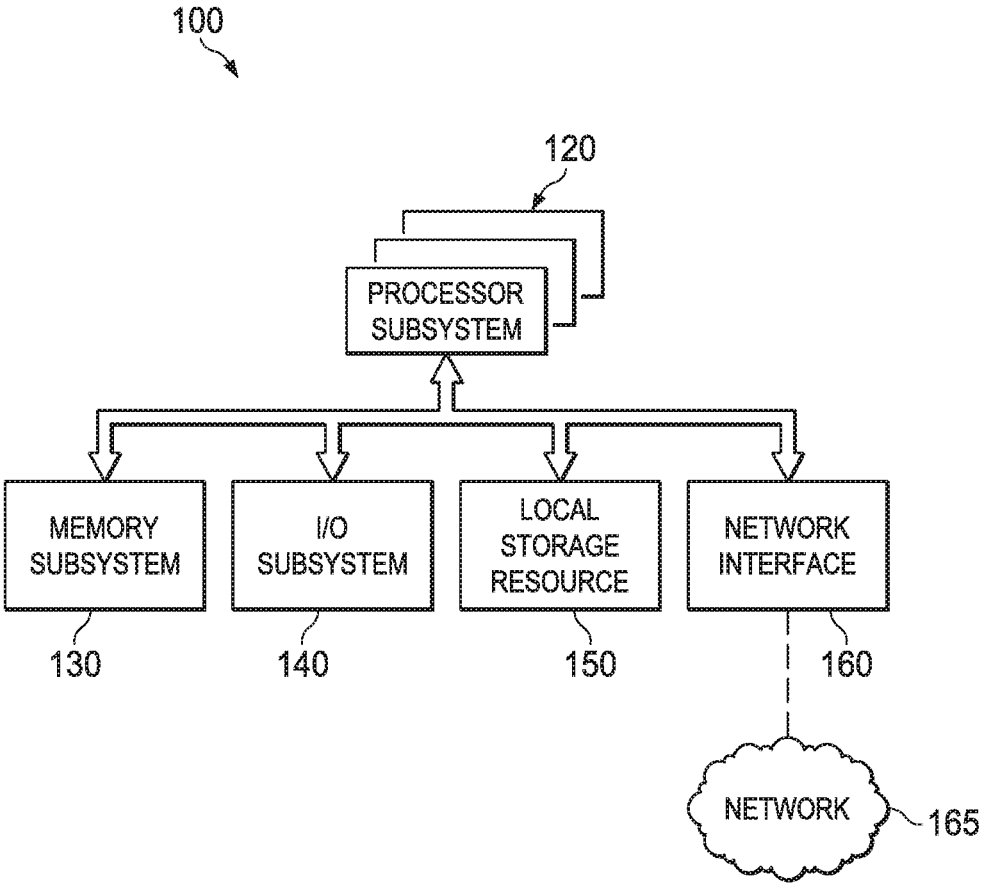
FIG. 1 illustrates a block diagram of selected elements of an embodiment of a portable information handling system.

In the following description, details are set forth by way of example to facilitate discussion of the disclosed subject matter. It should be apparent to a person of ordinary skill in the field, however, that the disclosed embodiments are exemplary and not exhaustive of all possible embodiments.

As used herein, a hyphenated form of a reference numeral refers to a specific instance of an element and the unhyphenated form of the reference numeral refers to the collective or generic element. Thus, for example, widget "72-1" refers to an instance of a widget class, which may be referred to collectively as widgets "72" and any one of which may be referred to generically as a widget "72."

A portable information handling system may include one or more rotationally-coupled housing portions coupled by a hinge assembly. For example, a lid housing portion of the portable information handling system may be coupled to a main housing portion by a hinge assembly such that the housing portions may be rotated in different positions to each other as a user uses, configures, and/or moves the portable information handling system. The housing portions may be comprised of a variety of materials. For example, the exterior of the housing portions may include durable, rigid materials capable of withstanding wear and tear while also protecting less-durable elements of the system. The interior of the housing portions may include the same or different materials to account for design, aesthetic, and/or other purposes.

As noted previously, portable information handling systems may utilize wireless communications to transmit and receive information. One or more antennas within the portable information handling systems may be used to transmit and receive information wirelessly. The performance of individual antennas may depend on, among other things, the position and/or surroundings of the antenna. As the portable information handling system is moved and arranged in different physical configurations, the position and/or surroundings of one or more antennas within the system may change. For example, an antenna in the lid portion of a portable information handling system may experience different orientations and/or surroundings (e.g., housing portions or external objects) as the lid housing portion is moved from closed position (e.g., zero degrees) to tablet position (e.g., 360 degrees) relative to the main housing portion. Thus, the performance and radiation pattern of the antenna may change as the portable information handling system is placed in different physical configurations.

The wireless communication performance of the portable information handling system may vary with the performance of individual antennas. In addition, the radiation patterns from the antennas may change based on the position and/or surroundings of the antennas which in turn may affect specific absorption rate (SAR) exposure requirements of the system as mandated by the Federal Communications Commission. Placement of antennas and selection of housing materials around and near the antennas may be selected to ensure robust antenna performance and compliance with SAR requirements. As the size of portable information handling systems continues to decrease (e.g., with narrow bezel designs), such placement of antennas and selection of housing materials may become more critical to ensuring robust wireless capabilities across the various supported physical configurations of the system.

For the purposes of this disclosure, an information handling system may include an instrumentality or an aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a server, a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

Particular embodiments are best understood by reference to FIGS. 1-8 wherein like numbers are used to indicate like and corresponding parts.

FIG. 1 illustrates a block diagram of selected elements of an embodiment of a portable information handling system 100 in accordance with some embodiments of the present disclosure. In various embodiments, portable information handling system 100 may represent different types of portable information handling systems, such as, smart phones, tablet computers, notebook computers, media players, digital cameras, 2-in-1 tablet-laptop combination computers, and wireless organizers. Components of portable information handling system 100 may include, but are not limited to, processor subsystem 120, which may comprise one or more processors, and system bus 121 that communicatively couples various system components to processor subsystem 120 including, for example, memory subsystem 130, I/O subsystem 140, local storage resource 150, and network interface 160. External or remote elements, such as network 165, are also shown to give context to an environment in which portable information handling system 100 may be configured to operate.

Processor subsystem 120 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data. In some embodiments, processor subsystem 120 may interpret and/or execute program instructions and/or process data stored locally (e.g., in memory subsystem 130). In the same or alternative embodiments, processor subsystem 120 may interpret and/or execute program instructions and/or process data stored remotely (e.g., in a network storage resource, not shown).

System bus 121 may represent a variety of suitable types of bus structures, including for example, a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, PCI bus, PCI-E bus, HyperTransport (HT) bus, Integrated Interchip Sound (IIS) bus, Serial Peripheral Interface (SPI) bus, and Video Electronics Standards Association (VESA) local bus, among others. Although illustrated as a single bus in FIG. 1, system bus 121 may be implemented as a combination of one or more suitable busses, and in some embodiments, various components may use one or more different busses to communicate with other components of portable information handling system 100.

Memory subsystem 130 may comprise a system, device, or apparatus operable to retain and/or retrieve program instructions and/or data for a period of time (e.g., computer-readable media). Memory subsystem 130 may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as portable information handling system 100, is powered down.

In portable information handling system 100, I/O subsystem 140 may comprise a system, device, or apparatus generally operable to receive and/or transmit data to/from/within portable information handling system 100. I/O subsystem 140 may represent, for example, a variety of communication interfaces, graphics interfaces, video interfaces, user input interfaces, and/or peripheral interfaces. For example, I/O subsystem 140 may comprise a touch panel and display adapter. The touch panel (not shown) may include circuitry for enabling touch functionality in conjunction with a display (not shown) that is driven by display adapter (not shown).

Local storage resource 150 may comprise computer-readable media (e.g., hard disk drive, floppy disk drive, CD-ROM, and/or other type of rotating storage media, flash memory, EEPROM, and/or another type of solid state storage media) and may be generally operable to store instructions and/or data. For example, local storage resource 150 may store executable code in the form of program files that may be loaded into memory 130 for execution. In addition to local storage resources 150, in some embodiments, portable information handling system 100 may communicatively couple via network 165 to a network storage resource (not shown) using network interface 160 discussed below.

Network interface 160 may be a suitable system, apparatus, or device operable to serve as an interface between portable information handling system 100 and network 165. Network interface 160 may enable portable information handling system 100 to communicate over network 165 using any suitable transmission protocol and/or standard, including, but not limited to various transmission protocols and/or standards. Network 165 coupled to network interface 160 may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and/or messages (generally referred to as data or information). In some embodiments, network 165 communicatively coupled to network interface 160 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. Network 165, network interface 160, and/or various components associated therewith may be implemented using hardware, software, or any combination thereof. Network interface 160 may enable wired and/or wireless communications to and/or from portable information handling system 100.

To communicate wirelessly, network interface 160 may use one or more antennas (not shown in FIG. 1). Antennas may include any suitable system, apparatus, or device capable of receiving and/or transmitting radio waves or other forms of electromagnetic radiation, including for example, a monopole antenna, dipole antenna, directional antenna, parabolic antenna, patch antenna, Planar Inverted-F Antenna (PIFA) antenna, slot antenna, microstrip antenna, sector antenna, or another suitable antenna. In some embodiments, portable information handling system 100 may use one or more different types of antennas to communicate with other wireless-enabled devices. Antennas may include any appropriate material, including for example, silver, copper, gold, aluminum, calcium, tungsten, zinc, nickel, iron, mylar, or another material suitable for transmitting and/or receiving radio signals or other forms of electromagnetic radiation, including a combination of one or more materials. In some embodiments, portable information handling system 100 may use antennas to communicate using one or more wireless communication standards, such as IEEE 802.11n or 802.11ac (Wi-Fi), Evolved High-Speed Packet access (HSPA+, or 3G), Worldwide Interoperability for Microwave Access (WiMAX), and/or Long Term Evolution (4G).

Figure 2:
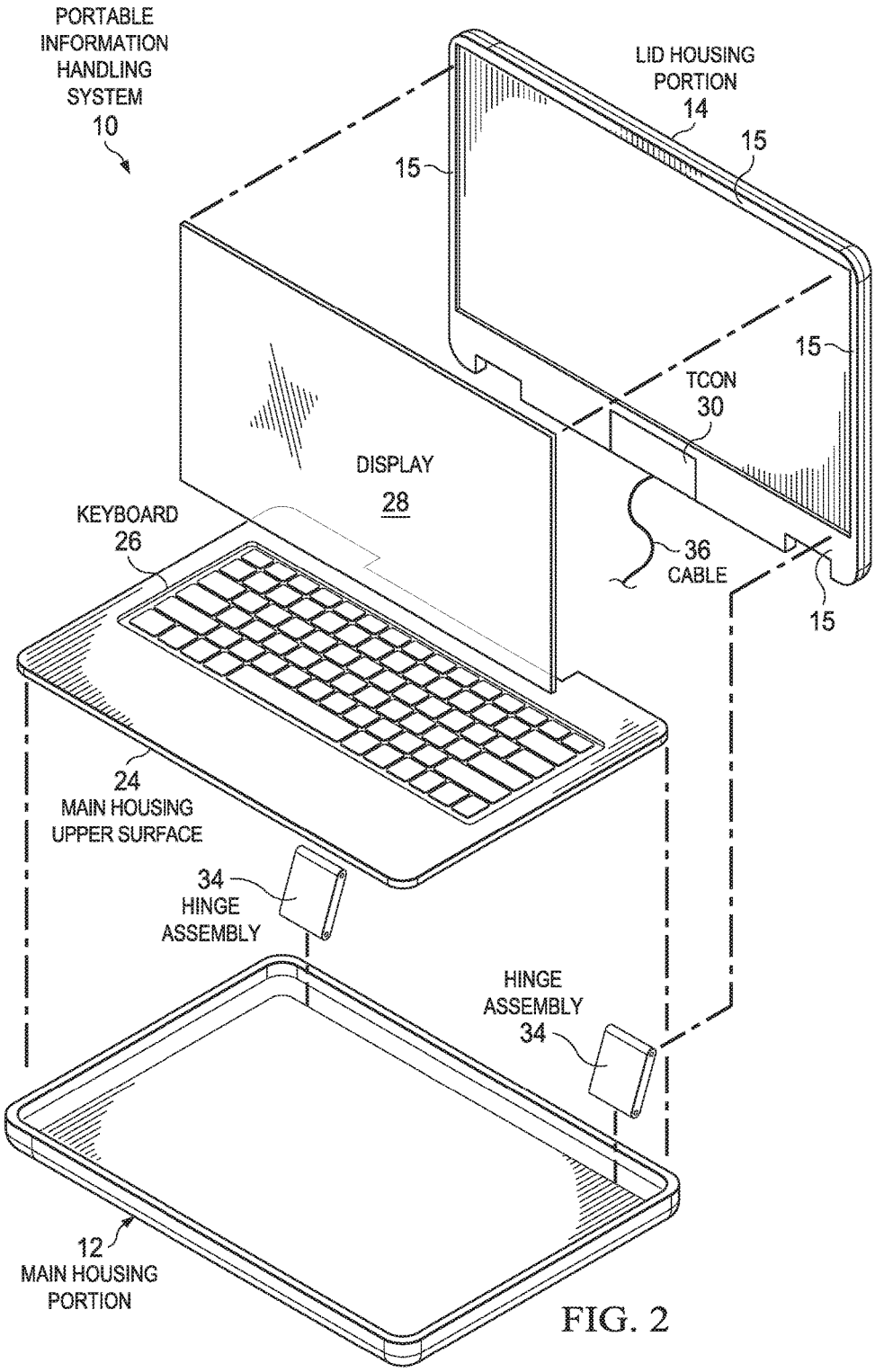
FIG. 2 illustrates a blown-up view of a portable information handling system having rotationally-coupled housing portions.

FIG. 2 illustrates a blown-up view of a portable information handling system having rotationally-coupled housing portions. In the example embodiment, a main housing portion 12 rotationally couples to a lid housing portion 14 to support various configurations to interact with an end user. Main housing portion 12 may hold one or more components of the portable information handling system, including but not limited to processor subsystem 120, system bus 121, memory subsystem 130, I/O subsystem 140, local storage resource 150, and network interface 160 discussed above with respect to FIG. 1. Main housing upper surface 24 couples to main housing portion 12, and may include an integrated keyboard 26 or other I/O devices, such as a mouse or microphone (not shown).

Lid housing portion 14 is rotationally coupled to main housing portion 12 via hinge assembly 34. Lid housing portion 14 includes display 28 that visually presents information to the user. Display 28 may be a touch panel with circuitry enabling touch functionality in conjunction with a display. In some embodiments, display 28 may be an "infinity edge" or "narrow bezel" display that approaches one or more the edges of lid housing portion 14 such that front bezel 15 may be narrow in size (e.g., 5-10 millimeters) on said edges. For example, display 28 is an infinity display with narrow bezels 15 on the top and sides of lid housing portion 14 in the embodiment displayed in FIG. 2.

Lid housing portion 14 may also include timing controller (TCON) 30. Hinge assembly 34 may include cable 36 for communicably coupling one or more components within main housing portion 12 to one or more components within lid housing portion 14. For example, cable 36 may provide communication of graphics information from an I/O subsystem to TCON 30 for generation of visual images for display on display 28. Although a single cable 36 is illustrated in FIG. 2, portable information handling system 10 may include one or more additional cables 36 for communicating components disposed in main housing portion 12 and lid housing portion 14. Placement of cable 36 may be selected based on design considerations, materials or manufacturing cost, material reliability, antenna placement, and/or other considerations.

Hinge assembly 34 allows main housing portion 12 and lid housing portion 14 to rotate between a plurality of positions. For example, when portable information handling system 10 is not in use, lid housing portion 14 may be closed over the top of main portion 12 such that display 28 and keyboard 26 are protected from unintended use and/or damage. Rotation of lid housing portion 14 by approximately 90 degrees from main housing portion 12 brings display 28 in a raised "clamshell" position relative to keyboard 26 so that an end user can make inputs to keyboard 26 and/or a touch panel portion of display 28 while viewing display 28. In some embodiments, clamshell position may represent lid housing portion 14 open between approximately 1 and 180 degrees from main housing portion 12. Rotation of lid housing portion 14 between approximately 180 and 359 degrees from main housing portion 12 may place portable information handling system 10 in "tablet stand" and/or "tent" positions. In tablet stand and tent positions, the user may make inputs via touch panel portion of display 28 while viewing display 28. A full 360 degree rotation of main housing portion 12 relative to lid housing portion 14 provides a tablet configuration having display 28 exposed to accept touch inputs. In any position, user inputs may be communicated to an I/O subsystem and/or a processor subsystem of the portable information handling system for processing, and then updated information may be communicated back via cable 36 to display 28 for displaying to the user. Hinge assembly may be comprised of one or more discrete hinges or a unified assembly of hinges.

Figure 3A:
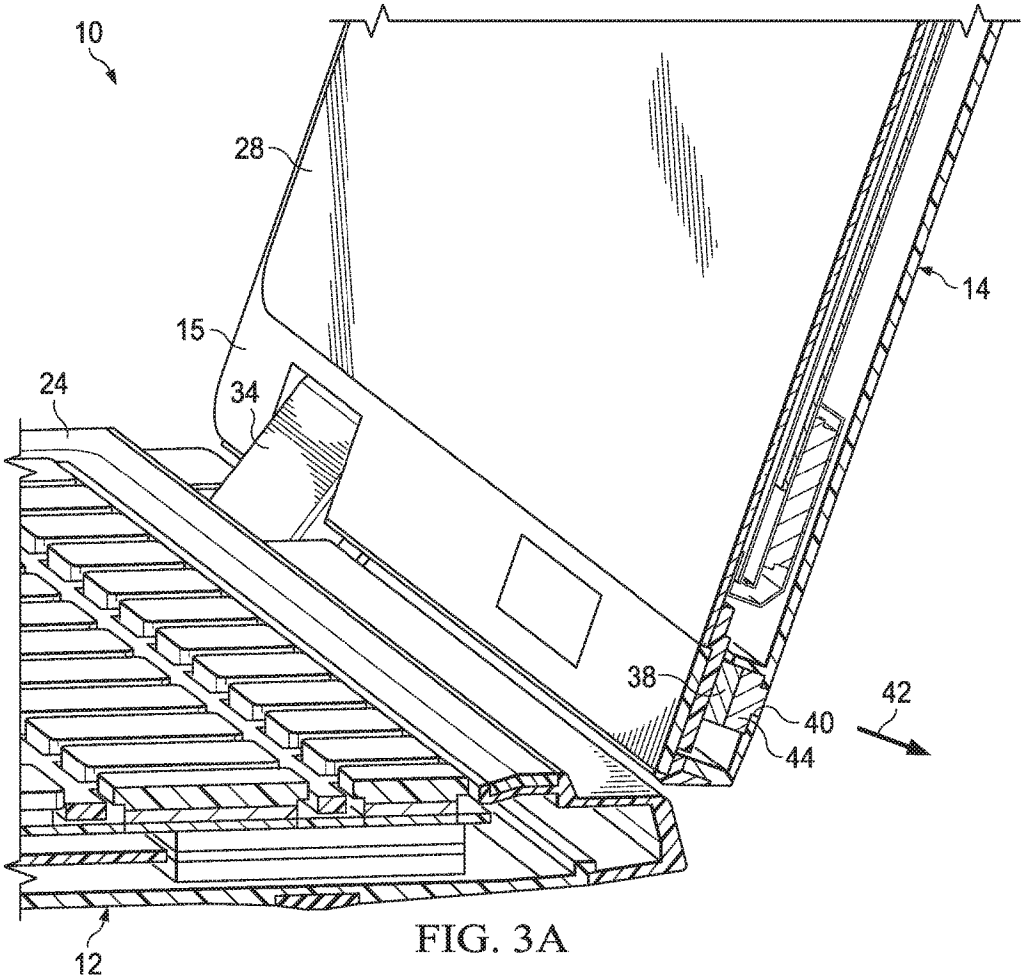
FIG. 3A illustrates a front perspective view of a portable information handling system in a clamshell open position.

FIG. 3A illustrates a front perspective, cross-sectional view of a portable information handling system in a clamshell open position. Portable information handling system 10 may include lid housing portion 14 and main housing portion 12 coupled by hinge assembly 34. As discussed above, display 28 may be an infinity edge display on the top and sides such that bezel 15 is narrow on said sides. The narrow portions of bezel 15 on the top and sides may limit the placement of certain elements within lid housing portion 14. For example, placement of antennas within lid housing portion 14 may be limited to the bottom space of lid housing portion 14 below display 28 and behind wider bezel 15. Placement limitations of elements, including antennas, may be the result of volume constraints (e.g., the thickness of lid housing portion 14 which may be designed slim in order to reduce the size and/or weight of the system), technical considerations (e.g., antennas behind display 28 may interfere with the display or vice-versa), SAR requirements, and/or other considerations.

Antenna 38 is shown in FIG. 3A below display 28 and behind wider section of bezel 15. Antenna 38 may include any type of antenna, including those discussed above with respect to FIG. 1. The performance of antenna 38 may be affected by the placement and/or surroundings of the antenna. For example, the performance of the antenna may be affected by the materials of the portable information handling system. Parts of lid housing portion 14 and main housing portion 12 may include durable, rigid materials (e.g., aluminum, carbon fiber, magnesium alloy, etc.) capable of withstanding wear and tear while also protecting less-durable elements of the system. However, such durable and rigid materials may have limited radio frequency (RF) permeability such that radio waves sent to and from antenna 38 may be reduced in strength or blocked by the material.

To optimize antenna performance, lid housing portion 14 may include antenna aperture 40 such that antenna beam 42 may penetrate the lid of the system. Antenna aperture 40 may be an opening in the electrically conductive, durable and rigid material used in the exterior of lid housing portion 14. The size, shape, and placement of antenna aperture 40 may be selected based on the type of antenna 38, location of antenna 38, structural considerations of lid housing portion 14, SAR requirements, aesthetics, and/or other factors. The space in lid housing portion 14 created by antenna aperture 40 may be an unfilled opening (e.g., a gap or empty space) in the lid of portable information handling system 10. In some embodiments, the space form antenna aperture 40 may be filled with an RF permeable material 44, such as silicon, plastic, glass-fill plastic, resin, and/or other materials with a dielectric constant less than approximately 5.0 and a loss tangent of less than approximately 0.02. RF permeable material 44 may cover any opening in lid housing portion 14 of the system from antenna aperture 40 while causing little or no interference to the radio waves to and from antenna 38. Similarly, bezel 15 may be designed of RF permeable material in order to minimize interference with radio waves to and from antenna 38.

Figure 3B:
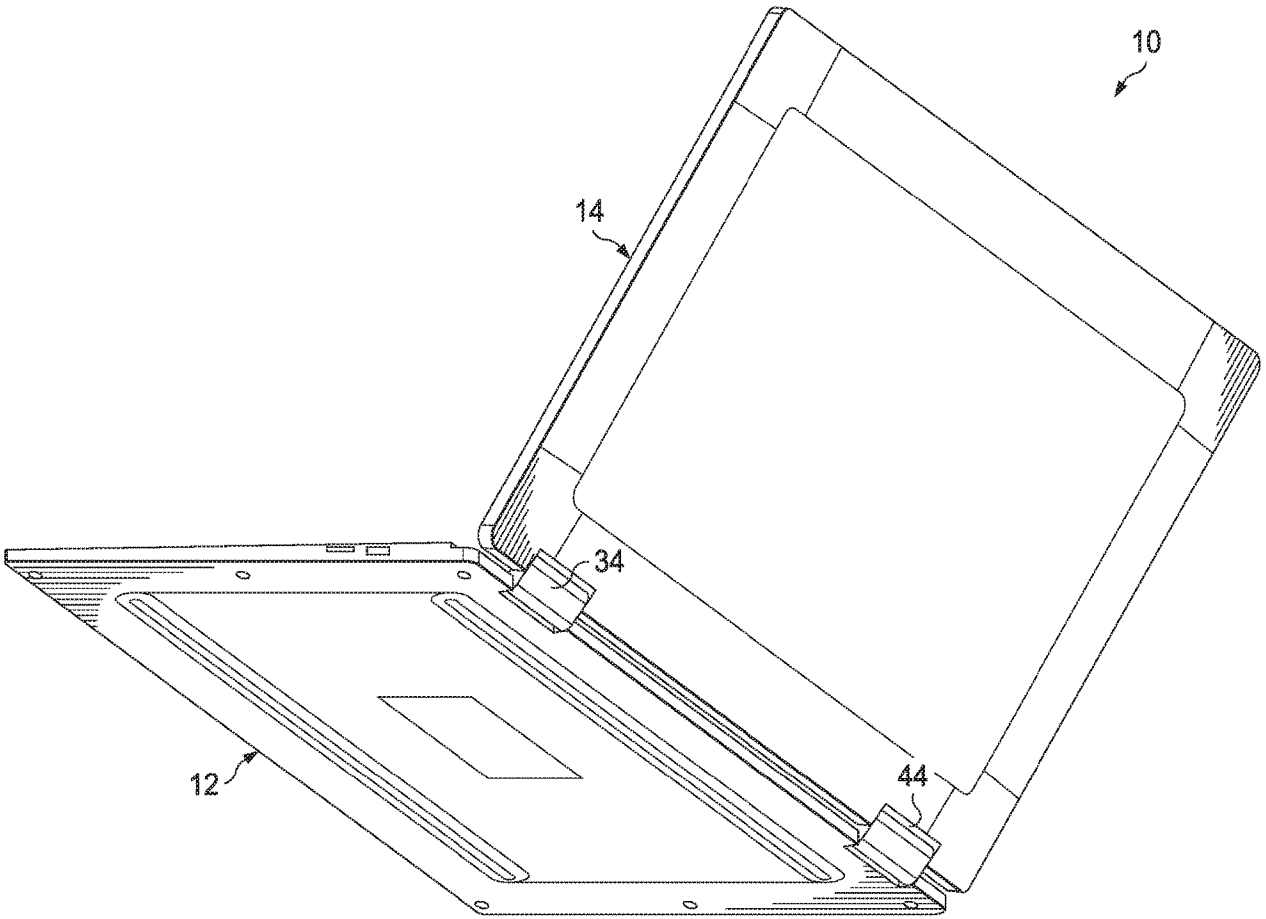
FIG. 3B illustrates a rear perspective view of a portable information handling system in a clamshell open position.

FIG. 3B illustrates a rear perspective view of a portable information handling system 10 in a clamshell open position. RF permeable material 44 is shown as a narrow line (e.g., 2 to 10 millimeters thick) that runs between the hinges of hinge assembly 34. In some embodiments, placement of RF permeable material 44 may be limited to the opening in lid housing portion 14 created by antenna aperture 40. In other embodiments, RF permeable material 44 may be placed in fewer or more locations on lid housing portion 14 for aesthetic, structural, and/or other reasons. As explained above, antenna aperture 40 may take any shape or form based on the considerations enumerated above with respect to FIG. 3A.

Figure 4:
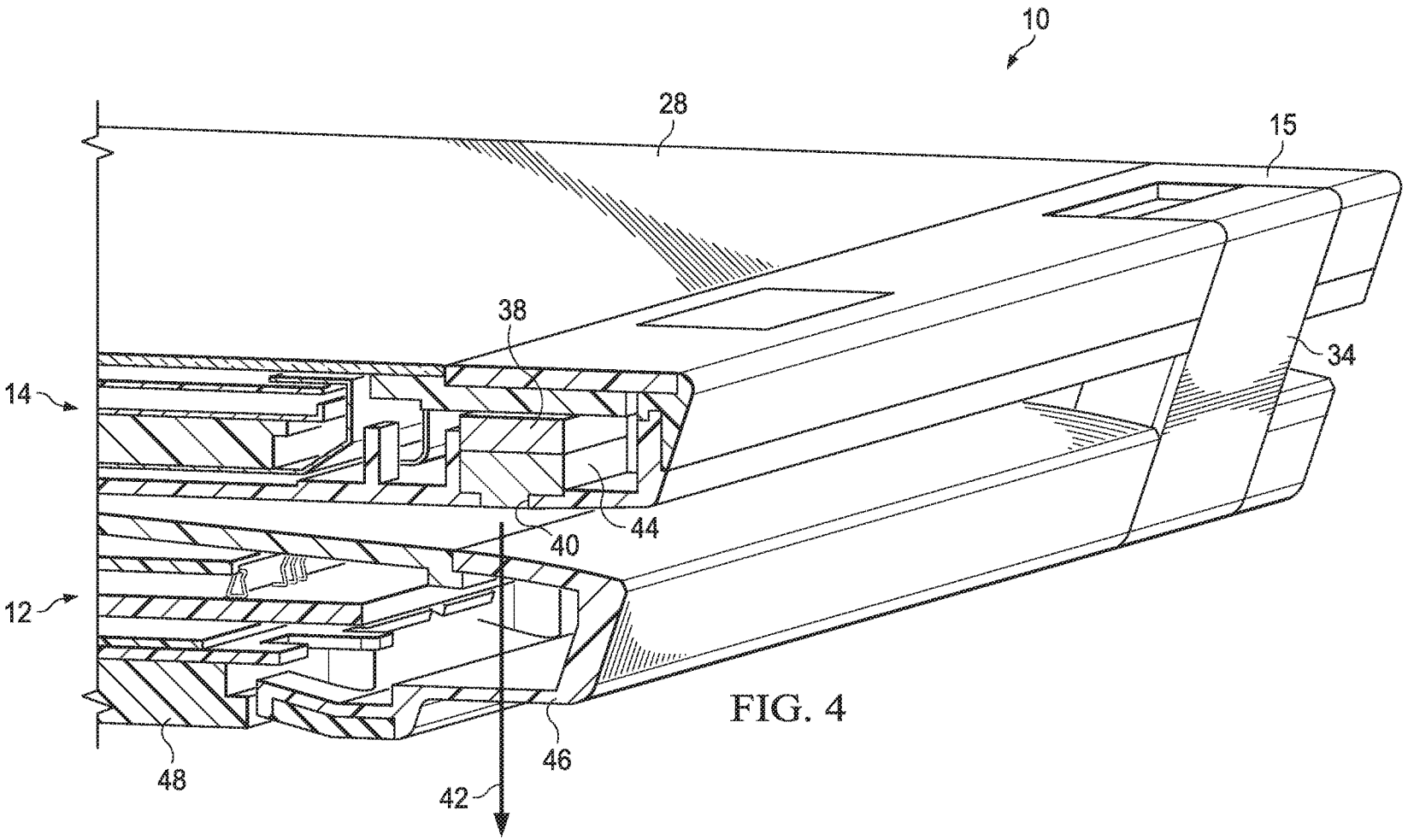
FIG. 4 illustrates a front perspective, cross-sectional view of a portable information handling system in a tablet position.

FIG. 4 illustrates a front perspective, cross-sectional view of a portable information handling system in a tablet position. In tablet position, lid housing portion 14 may be fully open from main housing portion 12 at approximately 360 degrees. Antenna 38 may be placed in close proximity to the exterior of main housing portion 12. Thus, antenna beam 42, previously directed away from portable information handling system 10 in clamshell open position of FIG. 3, may now be directed into main housing portion 12. The surroundings and placement of antenna 38 (e.g., in close proximity and directed into main housing portion 12), may cause interference with radio waves to and from the antenna. For example, main housing portion 12 may include durable, rigid materials (e.g., aluminum, carbon fiber, magnesium alloy, etc.) with limited RF permeability such that radio waves sent to and from antenna 38 (e.g., represented by antenna beam 42) may be reduced in strength or blocked by the material of the main housing portion.

To optimize antenna performance, one or more portions of main housing portion 12 may be comprised of RF permeable material to reduce interference with radio waves to and from antenna 38. For example, RF permeable material 46 may be used in regions of main housing portion 12 that could interfere with the performance of antenna 38 when portable information handling system 10 is placed in any of its supported physical configurations (e.g., clamshell, tablet stand, and/or tablet modes). As illustrated in FIG. 4, RF permeable material 46 may be used opposite antenna 38 and antenna aperture 40 when portable information handling system 10 is in tablet position. In tablet mode, RF permeable material 46 may permit antenna beam 42 to penetrate main housing portion 12 with limited degradation in antenna performance. The size, shape, and placement of RF permeable material 46 may be selected based on the type of antenna 38, location and size of antenna 38, location and size of antenna aperture 40, structural considerations of main housing portion 12, SAR requirements, aesthetics, and/or other factors. RF permeable material 46 may physically couple to durable material 48, forming the exterior of main housing portion 12. Durable material 48 may be comprised of durable, rigid materials having low-RF permeability, but because of its distance from antenna 38 and antenna aperture 40, durable material 48 may have limited or reduced effect on the performance of antenna 38.

Figure 5A:
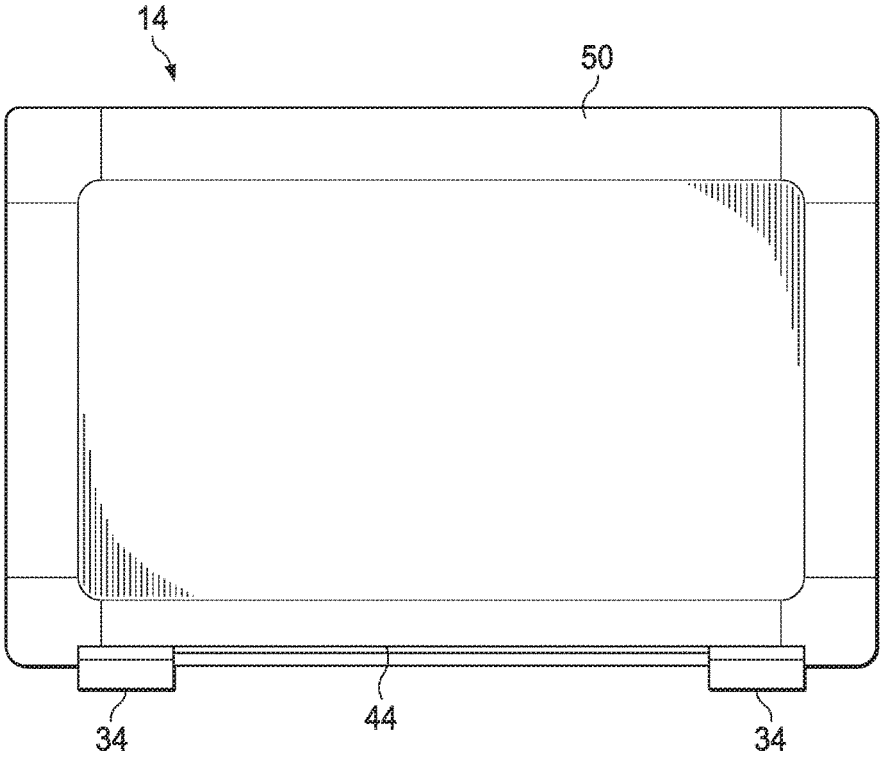
FIG. 5A illustrates the exterior of a lid housing portion of a portable information handling system.

FIG. 5A illustrates the exterior of a lid housing portion of a portable information handling system. Exterior side 50 of lid housing portion 14 of portable information handling system 10 may be comprised of one or more durable, rigid materials that are capable of withstanding wear and tear while also protecting less-durable elements of the system. Lid housing portion 14 may couple to hinge assembly 34 such that it may be rotated in different positions relative to the main housing portion of the system. RF permeable material 44 is shown between the hinges of hinge assembly 34, but as described above with respect to FIGS. 3A and 3B, RF permeable material 44 may be any size or shape.

Figure 5B:
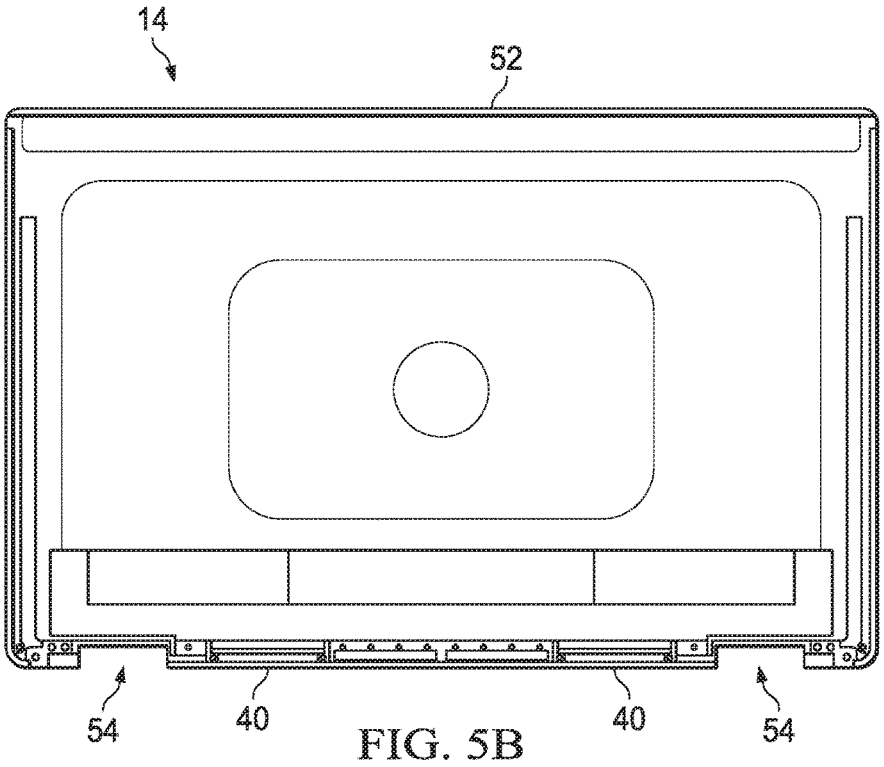
FIG. 5B illustrates the interior of a lid housing portion of a portable information handling system.

FIG. 5B illustrates the interior of a lid housing portion of a portable information handling system. Interior side 52 of lid housing portion 14 of portable information handling system 10 may be comprised of the same durable, rigid materials as exterior side 50 in FIG. 5A. Notches 54 represent where the hinges of hinge assembly 34 (not shown in FIG. 5B) may be placed and/or coupled to lid housing portion 14.

Portable information handling system 10 may have more than one antennas 38 for communicating wirelessly with other devices. Antennas 38 may be the same and/or different types, sizes, and/or configurations. As explained above with respect to FIGS. 3A and 3B, antennas 38 may be placed at or near antenna apertures 40 such that the beams of antennas 38 may penetrate lid housing portion 14 with minimal interference to the signal transmission and reception of the antenna. The size, shape, and placement of antenna apertures 40 may be selected based on the number of antennas 38, types of antennas 38, location of antennas 38, structural considerations of lid housing portion 14, SAR requirements, aesthetics, and/or other factors. In some embodiments, antenna apertures 40 may be different sizes and/or shapes than the RF permeable material 44 used to fill the gap created in the lid by antenna apertures 40. For example, antenna apertures 40 may be discrete openings in lid housing portion 14 as shown in FIG. 5B, while RF permeable material 44 may run the full length between the hinges of hinge assembly 34 as shown in FIG. 5A. RF permeable material 44 may be placed in fewer or more portions of lid housing portion 14 for aesthetic, structural, and/or other reasons.

Figure 6A:
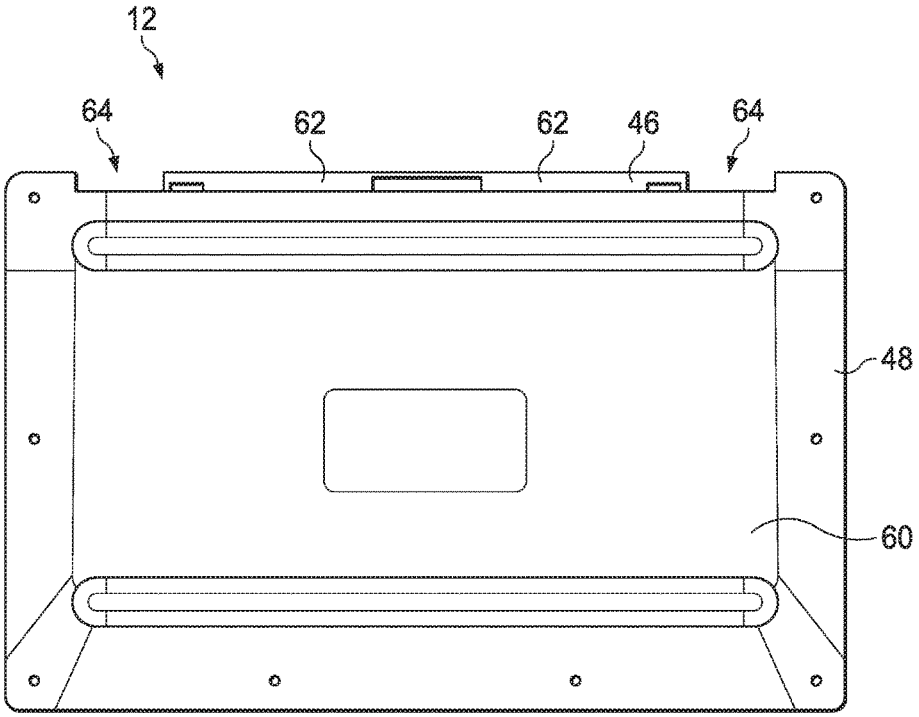
FIG. 6A illustrates the exterior of a main housing portion of a portable information handling system.

FIG. 6A illustrates the exterior of a main housing portion of a portable information handling system. Exterior side 60 of main housing portion 12 of portable information handling system 10 may be comprised of durable material 48 to help withstand wear and tear in addition to protecting less-durable elements of the system. Notches 64 represent where the hinges of hinge assembly 34 (not shown in FIG. 6A) may be placed and/or coupled to main housing portion 12.

As described above with respect to FIG. 4, main housing portion 12 may include RF permeable material 46 to reduce antenna interference and/or loading. Notches 62 may represent where RF permeable material 46 may be used instead of durable material 48. The size, shape, and placement of notches 62 and RF permeable material 46 may be selected based on the type of antennas 38, location of antennas 38, structural considerations of lid housing portion 14, SAR requirements, aesthetics, and/or other factors.

Figure 6B:
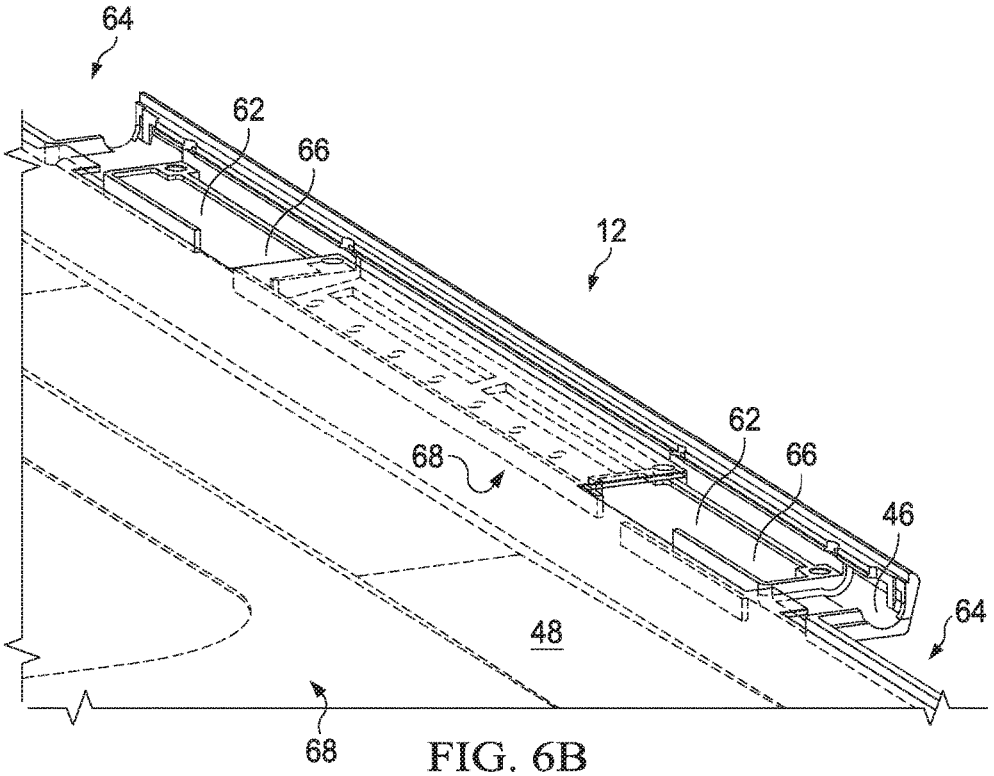
FIG. 6B illustrates a perspective view of the interior of a main housing portion of a portable information handling system

FIG. 6B illustrates a perspective view of the interior of a main housing portion of a portable information handling system. Interior side 68 of main housing portion 12 of portable information handling system 10 may be comprised of the same durable material 48 and RF permeable material 46 as exterior side 60 discussed in FIG. 6A.

In some embodiments, main housing portion 12 may include interference free zones. Interference free zones 62 may be RF permeable (e.g., empty space or space filled with RF permeable material) portions in main housing portion 12. In some embodiments, antenna walls 66 may be used to form interference free zones 62. Antenna walls 66 may be comprised of durable material 48, RF permeable material 46, a combination thereof, or another suitable material. In tablet position, interference free zones 62 may be located in proximity to antennas 38 located in lid housing portion 12. Interference free zones 62 may prevent components within main housing portion 12 from moving in proximity of antennas 38. For example, wires or other electrical components may change locations or positions as portable information handling system 10 is moved and/or configured by the user. Such components may affect the ability of antennas 38 to transmit and/or receive radio waves, thereby affecting the wireless performance of the portable information handling system. Interference free zones 62 may reduce such variation in antenna performance by preventing components within main housing portion 12 from moving in proximity of antennas 38 such that antennas 38 may maintain approximately consistent surroundings regardless of how portable information handling system 10 is moved and/or configured by the user. The size, shape, and placement of interference free zones 62 may be selected based on the number of antennas 38, types of antennas 38, location of antennas 38, structural considerations of lid housing portion 14, SAR requirements, aesthetics, and/or other factors.

Figure 7A:
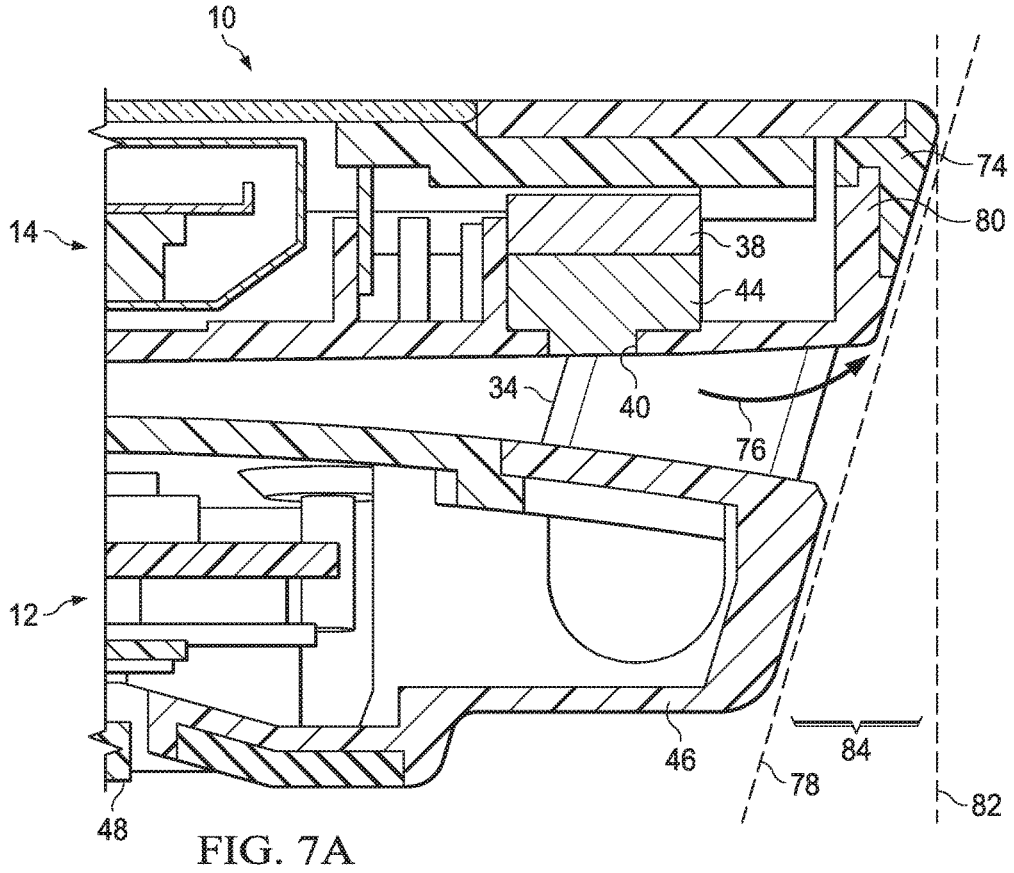
FIG. 7A illustrates a cross-sectional view of a portable information handling system in a tablet position.

FIG. 7A illustrates a cross-sectional view of a portable information handling system in a tablet position. In tablet position, lid housing portion 14 may be fully open from main housing portion 12 at approximately 360 degrees. Antenna 38 may be placed in close proximity to the exterior of main housing portion 12. As explained above with respect to FIGS. 5-6, portions of main housing portion 12 and lid housing portion 14 may be comprised of low-RF permeable material and/or RF permeable material. For example, main housing portion 12 may include RF permeable material 46 at or near antennas 38 and durable material 48 elsewhere. Lid housing portion 12 may include durable material 80 with antenna apertures 40 which in turn may be filled with an RF permeable material 44.

Radiation from antennas 38 may cause surface currents to form on durable material 80. Durable material may be comprised of electrically conductive material, such as aluminum, carbon fiber, and/or magnesium alloy. Thus, surface current created by antennas 38 may travel along the electrically conductive portions of lid housing portion 12. As shown by surface current arrow 76, some of the surface current created by antennas 38 may travel to portions of lid housing portion 12 that may be touched or handled by a user. The surface current may become concentrated near antennas 38 and/or antenna aperture 40. The surface current may increase SAR exposure beyond levels permitted by the FCC.

Lid housing portion 12 may include low-electrically conductive materials and/or slits to disperse surface currents such. Dispersing surface currents may reduce high concentrations of surface currents that tend to radiate and cause higher SAR measurements and risk. Low-electrically conductive material 74 may be used in lid housing portion 12 to electrically insulate the edges of lid housing portion 12 from surface currents. Low-electrically conductive material 74 may include silicon, plastic, glass-fill plastic, resin, and/or other materials that limit electrical conductivity (e.g., materials with an surface resistivity greater than 10 ohms/square). In some embodiments, low-electrically conductive material 74 may be part of or directly coupled to bezel 15 discussed above with respect to FIG. 2.

Figure 7B:
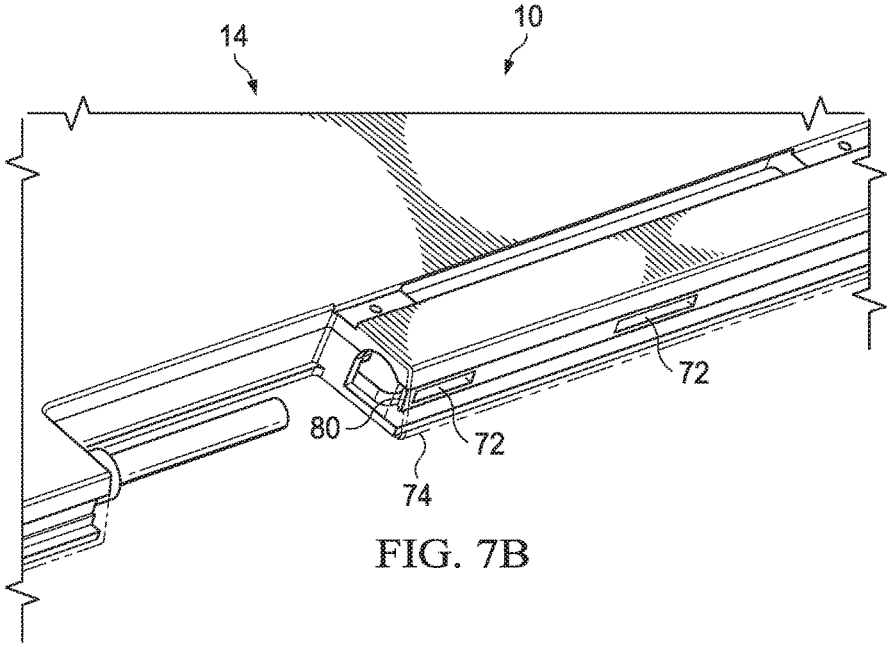
FIG. 7B illustrates a rear prospective view of a lid housing portion of a portable information handling system.

FIG. 7B illustrates a rear prospective view of a lid housing portion of a portable information handling system. Slits 72 may be placed in durable material 80 to dissipate surface currents created by antennas 38. Slits 72 may be open or filled with conductive material, such as conductive material 74. The location and size of low-electrically conductive material 74 and slits 72 may be made based on the type of antennas 38, location of antennas 38, structural considerations of lid housing portion 14, SAR requirements, aesthetics, and/or other factors.

The offset of lid housing portion 14 and main housing portion 12 in tablet position may reduce SAR measurement values and SAR exposure. For example, lid housing portion 14 may overhang main housing portion 12 in tablet mode. The amount of overhang may depend on hinge assembly 34 or other design factors of the housing of portable information handling system 10. The overhang may cause gap 84 to form between the actual edge of the system (e.g., represented by line 78) and vertical edge from the overhang (e.g., represented by line 82). The additional space represented by gap 84 may create distance between the user and/or SAR measurement edge of the system and the radiation from antennas 38. Thus, the offset of lid housing portion 14 and main housing portion 12 in tablet position may create an overhang that helps to reduce SAR measurement values and SAR exposure.

Figure 8:
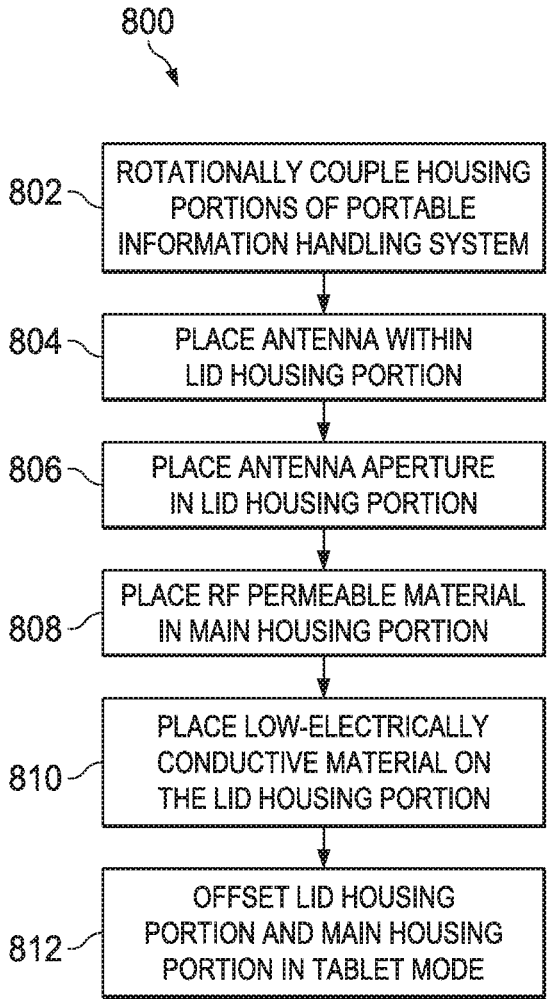
FIG. 8 illustrates a flowchart depicting selected elements of an embodiment of a method for integrating antennas in a narrow bezel portable information handling system in accordance with some embodiments of the present disclosure.

FIG. 8 illustrates an example method 800 incorporating antennas in a portable information handling system. Method 800 may begin at step 802, where the housing portions of the portable information handling systems are rotationally coupled by a hinge assembly. The hinge assembly may permit the housing portions to rotate to different positions from each other, including for example, closed, clamshell, tablet stand, tent, and tablet positions discussed above with respect to FIG. 2.

In step 804, method 800 places an antenna within the lid housing portion. The antenna may be any device that permits the information handling system to communicate over radio waves with a wireless-enabled device, including the exemplary antennas discussed above with respect to FIG. 1. In a narrow bezel design, the antenna may be placed below the display in the lid housing portion of the information handling system. The antenna may be placed below the display due to volume constraints, technical considerations (e.g., antennas behind the display may interfere with the display or vice-versa), SAR requirements, and/or other considerations.

In step 806, method 800 places an antenna aperture in the lid housing portion. The antenna aperture may permit the antenna in the lid housing portion to send and/or receive radio signals through the durable material of the lid housing portion. As explained above with respect to FIGS. 3-4, the antenna aperture size, shape, and location may be selected based on the type of antenna in the lid housing portion, the location of antenna, structural considerations of lid housing portion, SAR requirements, aesthetics, and/or other factors. In addition, the antenna aperture may be a gap or empty space in the lid of portable information handling system or the antenna aperture may be filled and/or covered with an RF permeable material.

In step 808, method 800 places RF permeable material within the main housing portion. As explained above with respect to FIGS. 3-4, the RF permeable material may be placed such that it is located in proximity to the antenna aperture and/or antenna when the portable information handling system is in tablet mode. The RF permeable material may permit the antenna in the lid housing portion to send and/or receive radio signals through the main housing portion more easily when the portable information handling system is in tablet mode.

In step 810, method 800 places low-electrically conductive material within the lid housing portion. As explained above with respect to FIGS. 7A and 7B, the low-electrically conductive material may be used to electrically insulate one or more edges of the lid housing portion from surface currents created by the antennas in the system. The low-electrically conductive material may be placed over slits placed in the durable material of the information handling system to dissipate surface currents created by the antennas in the system.

In step 812, method 800 offsets the lid housing portion and the main housing portion of the information handling system. As explained above with respect to FIG. 7B, the lid housing portion may overhang the main housing portion when the system is placed in tablet mode. The overhang may cause a gap to form between the actual edge of the system and the vertical edge from the overhang. The gap may create distance between the user and/or SAR measurement edge of the system and the radiation from antennas, thereby helping to comply with SAR requirements.

Method 800 may be implemented in any suitable manner. It is noted that certain steps or operations described in method 800 may be optional or may be rearranged in different embodiments.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, features, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A portable information handling system comprising:

a housing having a first housing portion and a second housing portion;

a hinge assembly rotationally coupling the first and second housing portions;

an antenna disposed within the first housing portion, the antenna operable to transmit radio waves; and an antenna aperture formed within the first housing portion such that at least a portion of the radio waves transmitted from the antenna travel through the antenna aperture;

the second housing portion comprising a radio frequency (RF) permeable region comprising RF permeable material, the RF permeable region located in proximity to the antenna aperture when the portable information handling system is in tablet mode, tablet mode representing the first housing portion rotated approximately 360 degrees from the second housing portion;

wherein the second housing portion comprises an interference free zone located in proximity to the antenna when the portable information handling system is in tablet mode such that at least a portion of the radio waves transmitted from the antenna travel through the interference free zone, the interference free zone comprising RF permeable components.

2. The system of claim 1, wherein RF permeable material covers the antenna aperture.

3. The system of claim 1, wherein an edge the first housing portion overhangs an edge of the second housing portion when the portable information handling system is in tablet mode.

4. The system of claim 1, wherein the first housing portion comprises an electrically conductive portion and a low-electrically conductive portion, wherein the low-electrically conductive portion is located at an edge of the first housing portion to dissipate a surface current created by the radio waves from the antenna.

5. The system of claim 4, wherein the electrically conductive portion comprises slits to dissipate the surface current created by the radio waves from the antenna.

6. The system of claim 5, wherein the low-electrically conductive portion covers the slits in the electrically conductive portion.

7. The system of claim 1, wherein the interference free zone comprises walls disposed within in the second housing portion, the walls forming an empty space within the second housing portion.

8. The system of claim 1, wherein the interference free zone comprises RF permeable material disposed within in the second housing portion.

9. A method of integrating an antenna in a portable information handling system, comprising:

rotationally coupling a first housing portion and a second housing portion of the portable information handling system with a hinge assembly;

placing the antenna within the first housing portion, the antenna operable to transmit radio waves;

forming an antenna aperture within the first housing portion such that at least a portion of the radio waves travel through the antenna aperture; and placing a radio frequency (RF) permeable region comprising RF permeable material within the second housing portion, the RF permeable region located in proximity to the antenna aperture when the portable information handling system is in tablet mode, tablet mode representing the first housing portion rotated approximately 360 degrees from the second housing portion;

wherein the second housing portion comprises an interference free zone located in proximity to the antenna when the portable information handling system is in tablet mode such that at least a portion of the radio waves transmitted from the antenna travel through the interference free zone, the interference free zone comprising RF permeable components.

10. The method of claim 9, wherein RF permeable material covers the antenna aperture.

11. The method of claim 9, wherein an edge the first housing portion overhangs an edge of the second housing portion when the portable information handling system is in tablet mode.

12. The method of claim 9, wherein the first housing portion comprises an electrically conductive portion and a low-electrically conductive portion, wherein the low-electrically conductive portion is located at an edge of the first housing portion to dissipate a surface current created by the radio waves from the antenna.

13. The method of claim 12, wherein the electrically conductive portion comprises slits to dissipate the surface current created by the radio waves from the antenna.

14. The method of claim 13, wherein the low-electrically conductive portion covers the slits in the electrically conductive portion.

15. The method of claim 9, wherein the interference free zone comprises walls disposed within in the second housing portion, the walls forming an empty space within the second housing portion.

16. A portable information handling system comprising:

a housing having a first housing portion and a second housing portion;

a hinge assembly rotationally coupling the first and second housing portions; and an antenna disposed within the first housing portion, the antenna operable to transmit radio waves;

the first housing portion including an electrically conductive portion and a low-electrically conductive portion, wherein the low-electrically conductive portion is located at an edge of the first housing portion to dissipate a surface current created by the radio waves from the antenna, wherein the electrically conductive portion comprises slits to dissipate the surface current created by the radio waves from the antenna.

17. The system of claim 16, wherein the low-electrically conductive portion covers the slits in the electrically conductive portion.

* * * * *